US006456188B1

(12) United States Patent
Tsuchiya

(10) Patent No.: US 6,456,188 B1
(45) Date of Patent: Sep. 24, 2002

(54) CONNECTING STRUCTURE OF A FUSE LINK AND EXTERNAL TERMINALS

(75) Inventor: Hirokazu Tsuchiya, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 85 days.

(21) Appl. No.: 09/717,134

(22) Filed: Nov. 22, 2000

(30) Foreign Application Priority Data

Nov. 25, 1999 (JP) ..... 11-333892

(51) Int. Cl.[7] ..... H01H 85/15; H01H 85/165; H01R 13/68

(52) U.S. Cl. ..... 337/235; 337/187; 337/191; 337/251; 337/252; 361/837; 439/366

(58) Field of Search ..... 337/159, 180, 337/181, 186, 187, 191, 231, 235, 251, 252; 439/890, 366; 361/837, 833, 642, 646

(56) References Cited

U.S. PATENT DOCUMENTS

| | | | | | |
|---|---|---|---|---|---|
| 1,455,566 | A | * | 5/1923 | Briggs | 337/187 |
| 3,205,410 | A | * | 9/1965 | Hobson, Jr. | 337/5 |
| 3,657,679 | A | * | 4/1972 | Wilson | 337/158 |
| 4,692,835 | A | * | 9/1987 | Setoguti et al. | 337/6 |
| 4,769,295 | A | * | 9/1988 | Kudo et al. | 429/121 |
| 5,088,940 | A | * | 2/1992 | Saito | 439/621 |
| 5,345,211 | A | * | 9/1994 | Muramatsu et al. | 337/186 |
| 5,580,281 | A | * | 12/1996 | Takeuchi | 337/210 |
| 5,620,337 | A | * | 4/1997 | Pruehs | 361/662 |
| 5,643,693 | A | * | 7/1997 | Hill et al. | 429/121 |
| 5,685,679 | A | * | 11/1997 | Sugiura | 337/263 |
| 5,700,165 | A | * | 12/1997 | Harris et al. | 439/188 |
| 6,333,846 | B1 | * | 12/2001 | Hashizawa et al. | 337/198 |

FOREIGN PATENT DOCUMENTS

| | | | | |
|---|---|---|---|---|
| DE | 296 07 130 U1 | | 7/1996 | |
| DE | 196 14 367 A1 | | 10/1996 | |
| EP | 0 699 565 A2 | | 3/1996 | |
| JP | 06-150989 | | 5/1994 | |
| JP | 6-295778 A | * | 10/1994 | H05B/3/00 |
| JP | 07-41947 | | 7/1995 | |
| JP | 08-289440 | | 11/1996 | |
| JP | 2000-182494 A | * | 6/2000 | H01H/37/76 |

* cited by examiner

*Primary Examiner*—Anatoly Vortman
(74) *Attorney, Agent, or Firm*—Armstrong, Westerman & Hattori, LLP

(57) ABSTRACT

A connecting structure of a fuse link 21 and external terminals 22,23 is provided, wherein a terminal connecting nut 27 is screwed to a male threaded portion 26 projecting through a metallic fuse member 25 of the fuse link 21 retained in a setting portion 24 so as to secure the external terminal 22 to the metallic fuse member 25 in a conductive state and a terminal connecting bolt 28 is put through both of the external terminal 23 and the metallic fuse member 25 and is screwed to a female threaded portion 68 so as to secure the external terminal 23 to the metallic fuse member 25 in a conductive state.

2 Claims, 7 Drawing Sheets

CONNECTING STRUCTURE OF A FUSE LINK AND EXTERNAL TERMINALS

BACKGROUND OF THE INVENTION

1. Field of the Invention

The present invention relates to a connecting structure of a fuse link and external terminals.

2. Description of the Related Art

A connecting structure of a fuse link and external terminals shown in FIG. 9 is generally known. First, the structure is described, and subsequently the connection will be described.

In FIG. 9, reference character 1 designates a fuse link already known. The fuse link 1 is detachably retained or held in a setting portion 3 of an object 2.

The fuse link 1 consists of a casing 4 to cover a non-shown fuse portion made of synthetic resin and a pair of terminals 5. A bolt through hole (not shown) is formed on each of the terminals 5.

The setting portion 3 has an accommodating recess 6 for the fuse link 1. Terminal through holes 8 for the terminals 5 are formed on a bottom wall 7 of the accommodating recess 6. The terminals 5 are aligned with the terminal through holes 8, and the fuse link 1 is moved toward the bottom wall 7 from an opening portion of the accommodating recess 6.

Nut fitting portions 9 are formed near respective terminal through holes 8. The nut fitting portions 9 are provided on respective sides of an intermediate wall 10. And, nuts 11,12 are inserted into the respective nut fitting portions 9 through nut fitting grooves 13,14. Reference characters 15,16 designate bases of the respective nut fitting grooves 13,14.

In the above structure, non-shown external terminals (i.e. plate terminals) are conductively-connected to the terminals 5 of the fuse link 1. The non-shown external terminals are fixed to the terminals 5 by terminal connecting bolts 17,18 by screwing them to the nuts 11,12.

With respect to the above prior art, however, the non-shown external terminals are likely to be connected to wrong positions (i.e. false assembly) because the terminals 5 and the non-shown external terminals are connected with the same couples of bolt and nut.

Referring to FIG. 9 further, though the terminal connecting bolts 17,18 can be different in size each other in order to recognize respective connecting positions, this causes poor workability and therefore could not provide a good solution to the above problem. More specifically, when the fuse link 1 is assembled to the setting portion 3 while facing them as shown in FIG. 9, it is not easy to fix the external terminals by inserting and tightening the bolts 17,18 to the external terminals. Inversely, if the work is performed while standing in an axial direction of the bolt 17 for example, the bolt 18 can not be seen, thereby also causing poor workability.

As described above, the problem of the false assembly of the external terminals and the poor workability require improvement of the prior art.

SUMMARY OF THE INVENTION

In view of the forgoing, an object of the present invention is to provide a connecting structure of a fuse link and external terminals wherein the false assembly can be prevented and the workability can be improved.

In order to achieve the above object, as a first aspect of the present invention, a connecting structure of a fuse link and external terminals comprises: the fuse link having a metallic fuse member having a fuse portion to be fused by overcurrent for circuit-breaking, a first conductor continuing from one end of the fuse portion, and the second conductor continuing from the other end of the fuse portion; a setting portion having a first connecting member having a male threaded portion and a second connecting member having a female threaded portion so as to retain the fuse link therein; and at least two external terminals to be connected to the metallic fuse member of the fuse link, wherein the male threaded portion is inserted into either one of the first conductor and the second conductor so as to secure at least one of the external terminals thereto by screwing the terminal connecting nut to the male threaded portion and the terminal connecting bolt is inserted into the other one of the first conductor and the second conductor so as to secure the other of the external terminals thereto by screwing the terminal connecting bolt to the female threaded portion.

According to the above-described structure, since the terminal connecting bolt and the terminal connecting nut are used for connection of the external terminals, connecting position of each of the external terminals becomes clear, thereby preventing false assembly thereof. More specifically, the setting portion has the first connecting member having the male threaded portion and the second connecting member having the female threaded portion. The male threaded portion of the first connecting member is inserted into one of the first and second conductors of the fuse link, and the terminal connecting nut is screwed to the male threaded portion. The terminal connecting bolt is inserted into the other of the first and second conductors of the fuse link, and the terminal connecting bolt is screwed to the female threaded portion of the second connecting member. And, since the terminal connecting bolt and the terminal connecting nut each tighten the corresponding external terminal to the fuse link, false assembly can be prevented.

As a second aspect of the present invention, in the structure as in the above first aspect, a base portion of the first connecting member and a base portion of the second connecting member are arrange on a substantially same plane.

According to the above-described structure, since the base portion of the first connecting member and the base portion of the second connecting member are arranged on the substantially same plane, the external terminals can be conductively-connected to the fuse link while looking at the first connecting member and the second connecting member. Accordingly, its workability can be improved.

The above and other objects and features of the present invention will become more apparent from the following description taken in conjunction with the accompanying drawings.

DESCRIPTION OF THE PREFERRED EMBODIMENT(S)

An embodiment of the present invention will now be described in further detail with reference to the accompanying drawings.

Figure 1A:
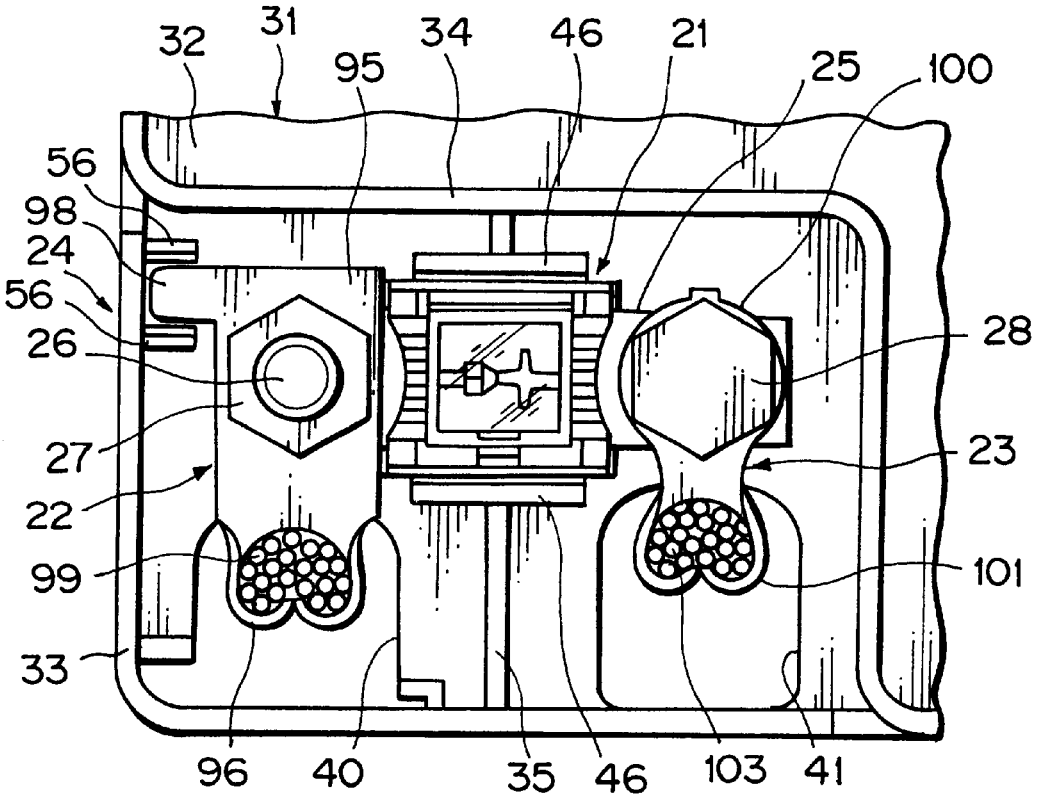
FIG. 1A is a plan view showing an embodiment of a connecting structure of a fuse link and external terminals in accordance with the present invention in a state that the external terminals are connected to the fuse link retained in a setting portion.
Figure 1B:
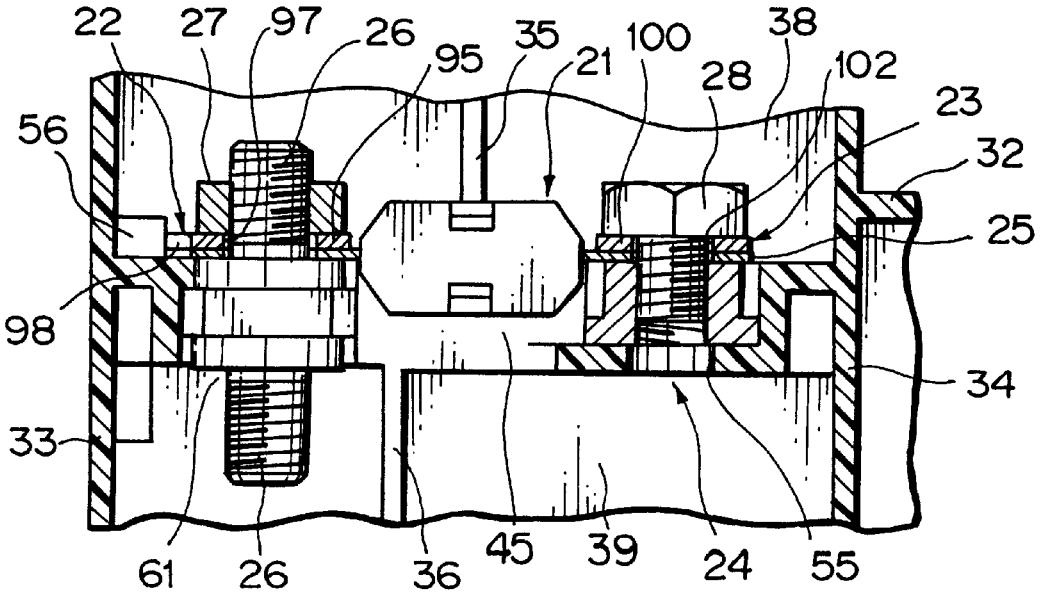
FIG. 1B is a sectional view of the connecting structure shown in FIG. 1A.
Figure 2A:
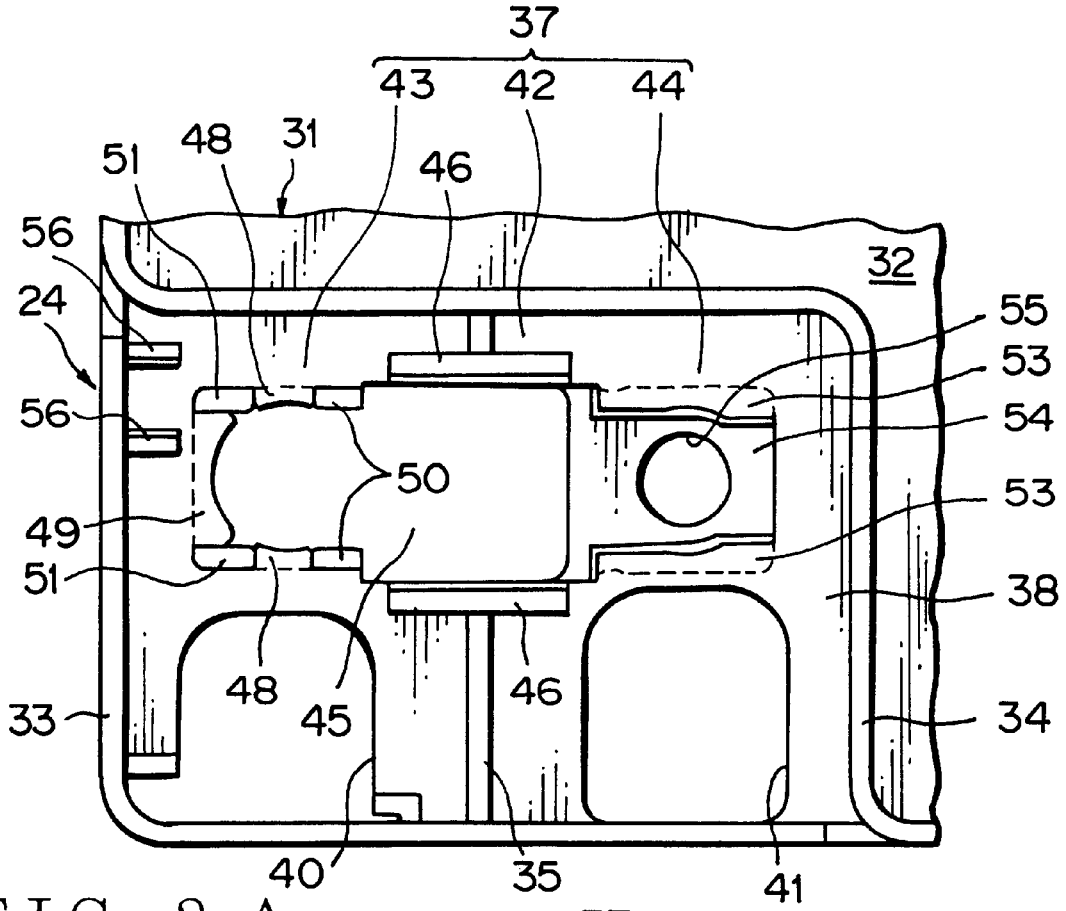
FIG. 2A is a plan view showing the setting portion, in which the fuse link is set, provided on an object to which the fuse link is attached.
Figure 2B:
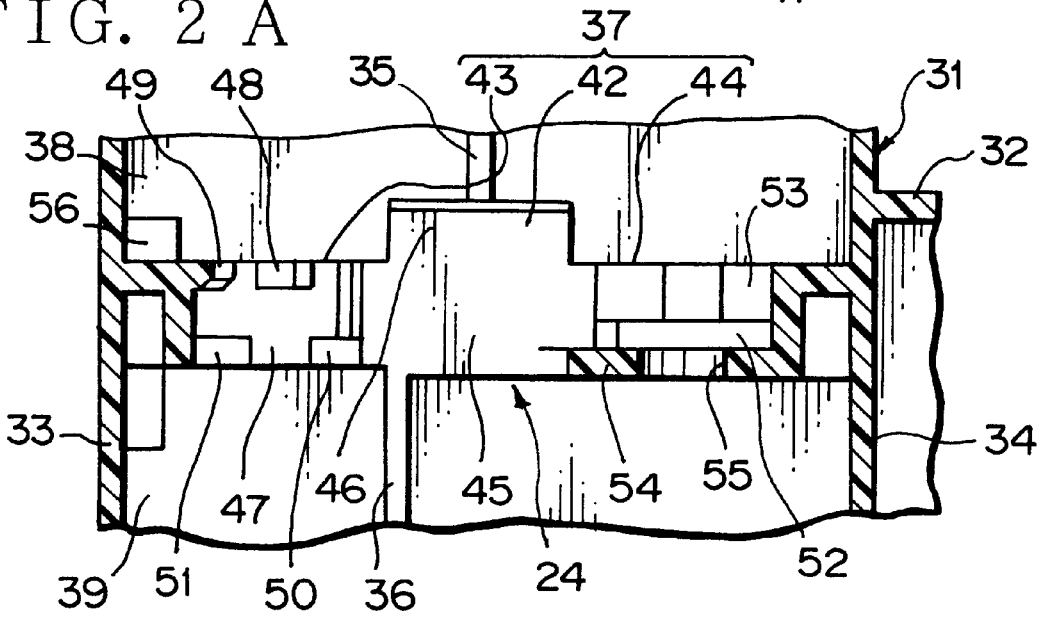
FIG. 2B is a sectional view of the setting portion shown in FIG. 2A.
Figure 9:
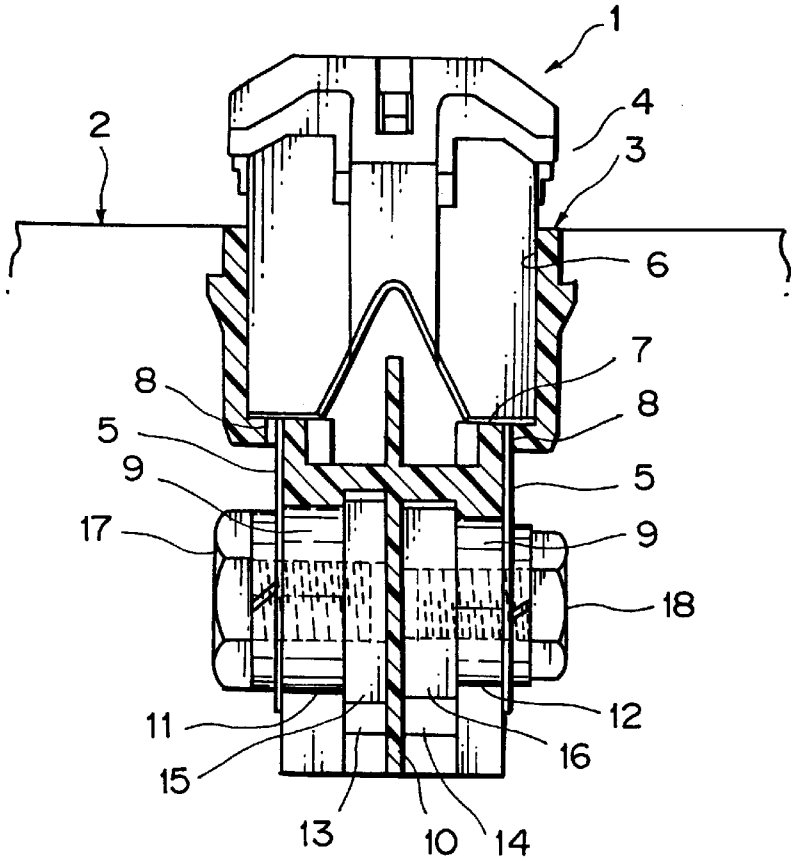
PRIOR ART FIG. 9
FIG. 9 is a sectional view showing a prior art connecting structure of a fuse link and external terminals.
Figure 4A:
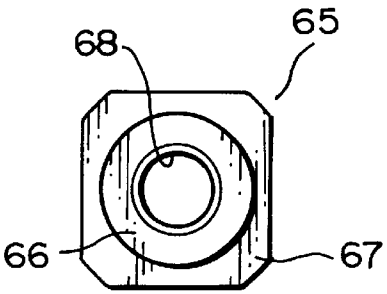
FIG. 4A is a plan view showing a second connecting member.
Figure 4B:
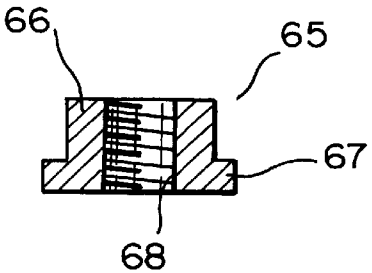
FIG. 4B is a front view of the second connecting member shown in FIG. 4A.
Figure 3A:
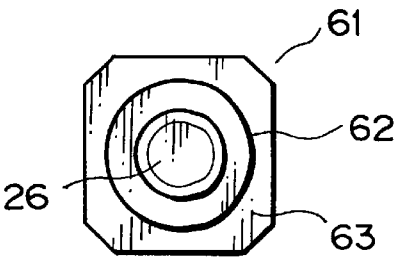
FIG. 3A is a plan view showing a first connecting member.
Figure 3B:
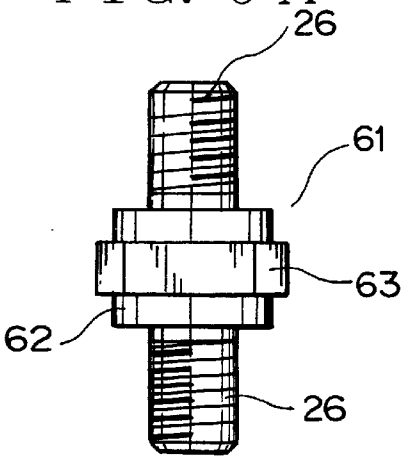
FIG. 3B is a front view of the first connecting member shown in FIG. 3A.
Figure 5A:
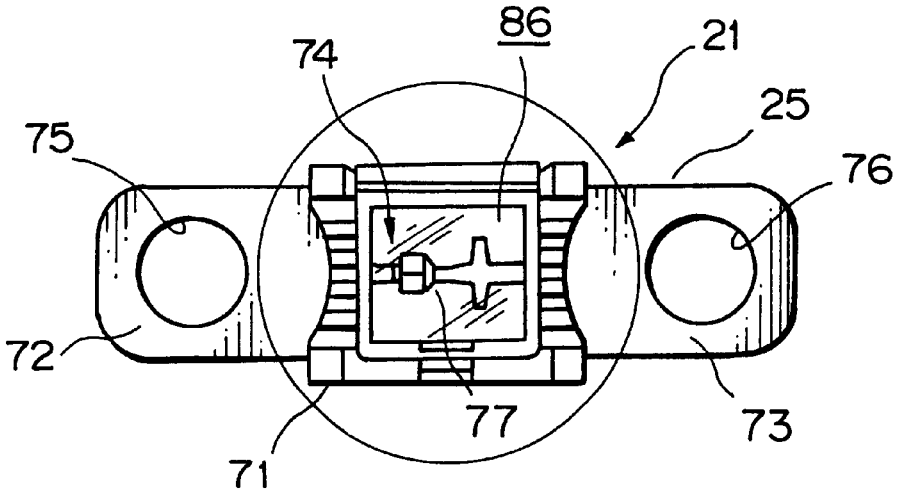
FIG. 5A is a plan view showing the fuse link.
Figure 5B:
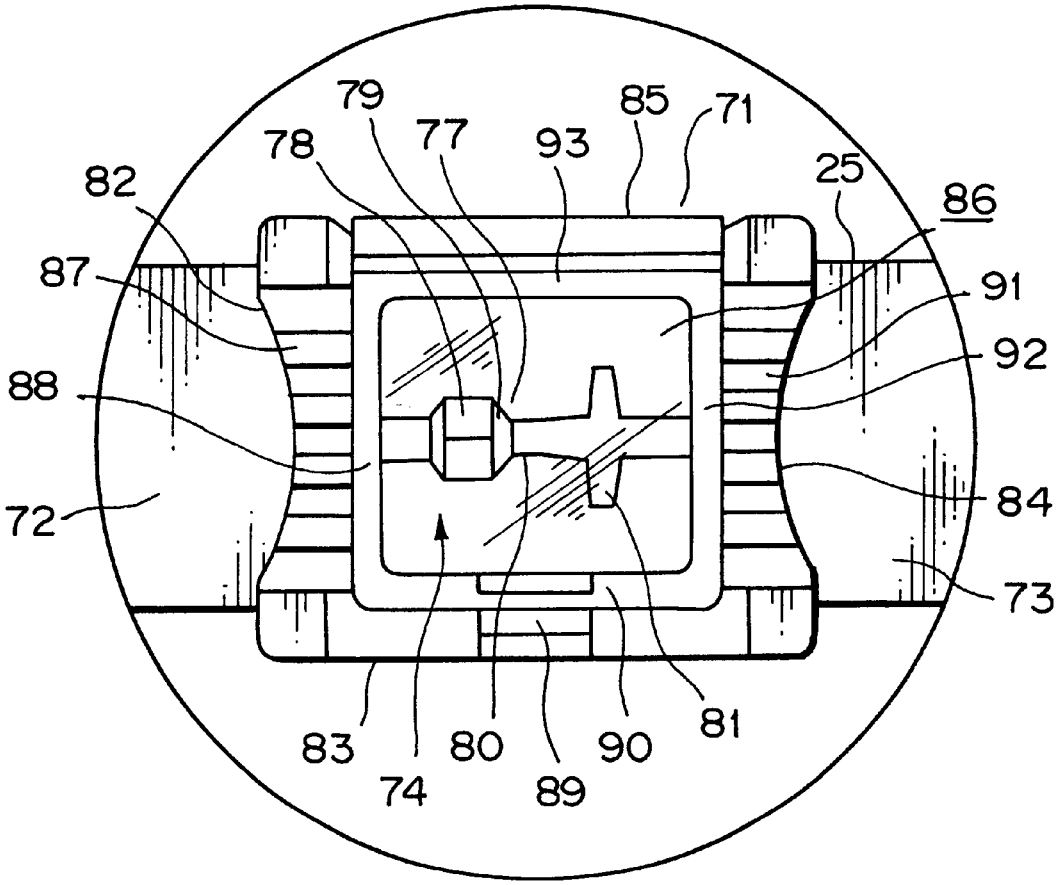
FIG. 5B is an enlarged plan view of a fuse portion of the fuse link.

FIG. 1A is a plan view showing an embodiment of a connecting structure of a fuse link and external terminals in accordance with the present invention in a state that the external terminals are connected to the fuse link retained in a setting portion. FIG. 1B is a sectional view of the connecting structure shown in FIG. 1A FIG. 2A is a plan view showing the setting portion, in which the fuse link is set, provided on an object to which the fuse link is attached. FIG. 2B is a sectional view of the setting portion shown in FIG. 2A. FIG. 3A is a plan view showing a first connecting member. FIG. 3B is a front view of the first connecting member shown in FIG. 3A. FIG. 4A is a plan view showing a second connecting member. FIG. 4B is a front view of the second connecting member shown in FIG. 4A. FIG. 5A is a plan view showing the fuse link. FIG. 5B is an enlarged plan view of a fuse portion of the fuse link.

A connecting structure of a fuse link and external terminals shown in FIG. 1A and FIG. 1B is provided in order to conductively-connect external terminals 22,23 to a fuse link 21 without wrong assembling. A terminal connecting nut 27 screws to a male threaded portion (i.e. a bolt) 26 projecting through a metallic fuse member 25 of the fuse link 21 retained (or held) in a setting portion 24. The external terminal 22 is secured to the metallic fuse member 25 in a conductive state. And, a terminal connecting bolt 28 is put through both of the external terminal 23 and the metallic fuse member 25 and is screwed to a female threaded portion 68 so as to secure the external terminal 23 to the metallic fuse member 25 in a conductive state.

The above structural members are described hereinafter. First, the setting portion 24 is described.

As shown in FIGS. 2A, 2B, the setting portion 24 is provided, for example, on a casing 32 of a relay box 31 made of synthetic resin. And, the setting portion 24 is sectioned with partitions 33,34 at a corner portion of the casing 32. Reference characters 35,36 show reinforcing walls.

Referring to FIGS. 1A, 1B, the setting portion 24 is provided on an object to which the fuse link 21 is to be attached and has a setting space 37 for the fuse link 21. And, spaces 38,39 for the fuse link 21 and the external terminals 22,23 are provided on both sides of the setting portion 24 by means of the partitions 33,34. And, openings 40,41 for the external terminals 22,23 are formed in the setting portion 24.

The setting space 37 consists of a housing retaining space 42, a first conductor setting space 43, and a second conductor setting space 44.

Formed in the housing retaining space 42 are a housing receiving space 45 to be a generally rectangular opening and retaining walls 46 arranged almost at the both side-edges of the housing receiving space 45. The retaining walls 46 project toward the space 38 in parallel each other and connected to respective reinforcing walls 35.

A placing space 47, in which a later-described first connecting member 61 (FIGS. 3A, 3B) is fitted through the housing receiving space 45, is formed in the first conductor setting space 43. The placing space 47 is surrounded with the projections 48,49 provided on a side of the space 38 and with the projections 50,51 on a side of the space 39. And, the placing space 47 is formed to communicate with the housing receiving space 45 and the spaces 38,39.

The projections 48 face each other similarly to the retaining walls 46 facing each other, while each having a circular-arc inside surface. And, the projections 48 are arranged around a longitudinal axis of a later-described first connecting member 61 (FIGS. 3A, 3B), which longitudinal axis crosses at right angles to a longitudinal axis of the setting space 37.

The projection 49 is formed at one longitudinal end of the setting space 37 and has a circular-arc recess at its top end. The arc at the top end thereof is in the same shape as of the projections 48.

The projection 50 and the projection 51 are arranged on respective sides of the projection 48, as shown in FIG. 2A. And, the projections 50,51 have the same height as of the projections 48.

A placing space 52, in which a later-described second connecting member 62 (FIGS. 4A, 4B) is fitted through the housing receiving space 45, is formed in the second conductor setting space 44. The placing space 52 is surrounded with the projecting walls 53 provided on a side of the space 38 and with a receiving wall 54 on a side of the space 39. And, the placing space 52 is formed to communicate with the housing receiving space 45 and the spaces 38,39.

The projecting walls 53 face each other along the longitudinal axis of the setting space 37 in the same way as the retaining walls 46. And, the projecting walls 53 are arranged around a longitudinal axis of a later-described second connecting member 65 (FIGS. 4A, 4B), which longitudinal axis crosses at right angles to the longitudinal axis of the setting space 37. The projecting wall 53 is provided with a circular-arc recess (its reference character is not shown) at its top end.

The receiving wall 54 extends from the housing receiving space 45 to the other end of the setting space 37 and has a circular hole 55 to communicate with the space 39. The circular hole 55 has the same longitudinal axis as of the second connecting member 65 (FIGS. 4A, 4B) and has a larger diameter than that of the bottom circle of a later-described female thread portion 68 (i.e. a nut) (FIGS. 4A, 4B).

A base portion 62 (FIGS. 3A, 3B) of the first connecting member 61 and a base portion 66 (FIGS. 4A, 4B) of the second connecting member 65 are arranged on the substantially same plane in the respective placing spaces 47,52. Therefore, the external terminals 22,23 (FIGS. 1A, 1B) can be conductively-connected to the fuse link 21 (FIGS. 1A, 1B) while looking at the first connecting member 61 (FIGS. 3A, 3B) and the second connecting member 65 (FIGS. 4A, 4B).

The openings 40,41 each are approximately in a U-shape and separated by the partition 33, are useful for connection work of the external terminals 22,23 (FIG. 1) for example.

A pair of retaining walls 56 continuing to the partition 33 are formed on the setting portion 24. The retaining walls 56 are formed on a side of the space 38 and a portion of the external terminal 22 (FIGS. 1A, 1B) is put therein.

In FIGS. 3A, 3B, the first connecting member 61 to be placed in the placing space 47 (FIG. 2B) of the first conductor setting space 43, and consists of the base portion 62 and the male thread portions 26 provided on both sides of the base portion 62.

The base portion 62 is formed in a substantially cylindrical shape and is provided with a flange 63 of a generally square tubular shape on the periphery thereof. Each corner portion of the flange 63 is cut out. The first connecting member 61 may have one male thread portion 26 instead of the two ones.

In FIGS. 4A, 4B, the second connecting member 65 to be placed in the placing space 52 (FIG. 2B) of the second conductor setting space 44, and consists of the base portion 66 and a flange 67 integrally formed with the base portion 66. The base portion 66 is formed in a substantially cylindrical shape and has the female thread portion 68. Each corner portion of the flange 67 is cut out. The second connecting member 65 can be substituted by a general nut, which, however, has to be provided with a turn-preventing means.

In FIG. 5, the fuse link 21 consists of a metallic fuse member 25, a resin housing 71 integrally molded with the metallic fuse member 25, and a transparent cover (not shown).

The metallic fuse member 25 is formed integrally by pressing a conductive sheet metal and has a first conductor 72, a second conductor 73, and a fuse portion 74.

A fitting hole 75 for the male thread portion 26 (FIGS. 1A, 1B) is provided on the first conductor 72. And, a fitting hole 76 for a bolt 28 is provided on the second conductor 73. The fitting holes 75,76 are arranged on the longitudinal axis of the fuse link 21.

The first and second conductors 72,73 are in the same shape and are arranged symmetrically.

The fuse portion 74 has a fuse body 77 and continues to both of the first conductor 72 and the second conductor 73. The fuse body 77 is to designed cut a circuit by a melt-breaking due to an excessive current and consists of a cramp 78, for example a tin chip 79 cramped by the cramp 78, a neck portion 80 formed a little narrowly, and a blade portion 81.

The resin housing 71 is in a four-side frame shape and molded out of synthetic resin integrally with the metallic fuse member 25, and has first to fourth reinforcing walls 82–85. And, an opening space 86 to make the fuse portion 74 exposed is formed by the reinforcing walls 82–85. The first and third reinforcing walls 82,84 are in the same shape and are arranged symmetrically.

The first reinforcing wall 82 is formed over the front and back of the first conductor 72, and a plurality of radiating fins 87 are formed on each of the front and back. And, at the edge on a side of the opening space 86 a receiving portion 88 for the above transparent cover (not shown) is formed.

The second reinforcing wall 83 is formed between the first conductor 72 and the second conductor 73 over the front and back sides thereof. An engaging portion 89 for the above transparent cover (not shown) and a receiving portion 90 are formed on the second reinforcing wall 83.

The third reinforcing wall 84 is formed over the front and back of the second conductor 73, and a plurality of radiating fins 91 are formed on each of the front and back. And, at the edge on a side of the opening space 86 a receiving portion 92 for the above transparent cover (not shown) is formed.

The fourth reinforcing wall 85 is formed between the first conductor 72 and the second conductor 73 over the front and back sides thereof, while facing the second reinforcing wall 83. A receiving portion 93 for the above transparent cover (not shown) is formed on the fourth reinforcing wall 85.

In FIGS. 1A, 1B, the above external terminal 22 consists of an electrically contacting portion 95 in a generally rectangular shape and a wire connecting portion 96 continuing from the electrically contacting portion 95, and formed in a plate-like shape. A fitting hole 97 for the male threaded portion 26 and a projecting portion 98 to be put between the retaining walls 56 are provided on the electrically contacting portion 95. An electric wire 99 is clamped to the wire connecting portion 96.

In FIGS. 1A, 1B, the above external terminal 23 consists of an electrically contacting portion 100 in a generally annular shape and a wire connecting portion 101 continuing from the electrically contacting portion 100, and formed in a plate-like shape. A fitting hole 102 for the bolt 28 is provided on the electrically contacting portion 100. An electric wire 103 is clamped to the wire connecting portion 101.

Next, the assembly steps until the fuse link 21 is set and retained in the setting portion 24, are shown on FIGS. 6A, 6B, 7A, 7B.

Figure 6A:
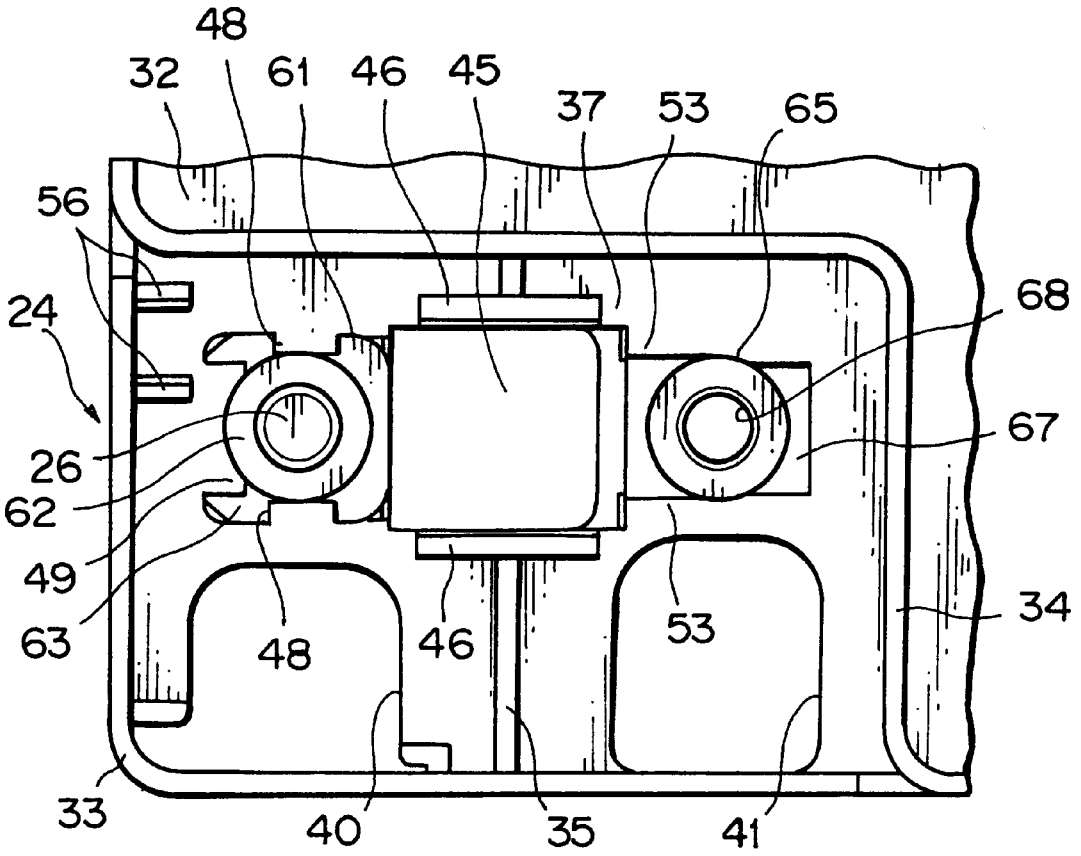
FIG. 6A is a plan view showing the setting portion on which the first and second connecting members having been assembled.
Figure 6B:
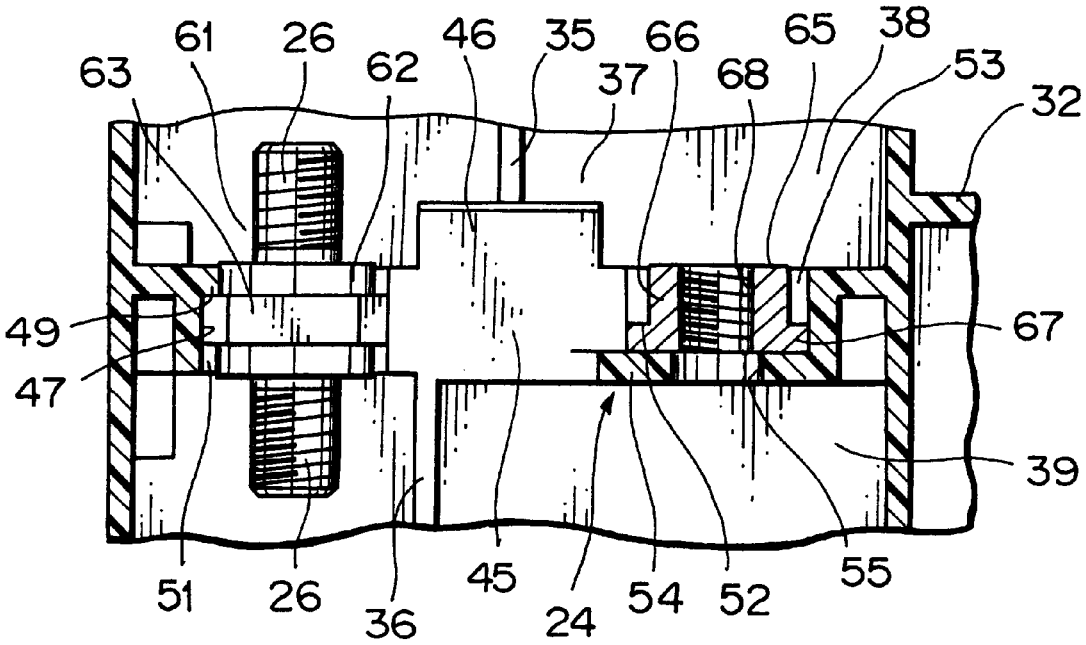
FIG. 6B is a sectional view of FIG. 6A.
Figure 7A:
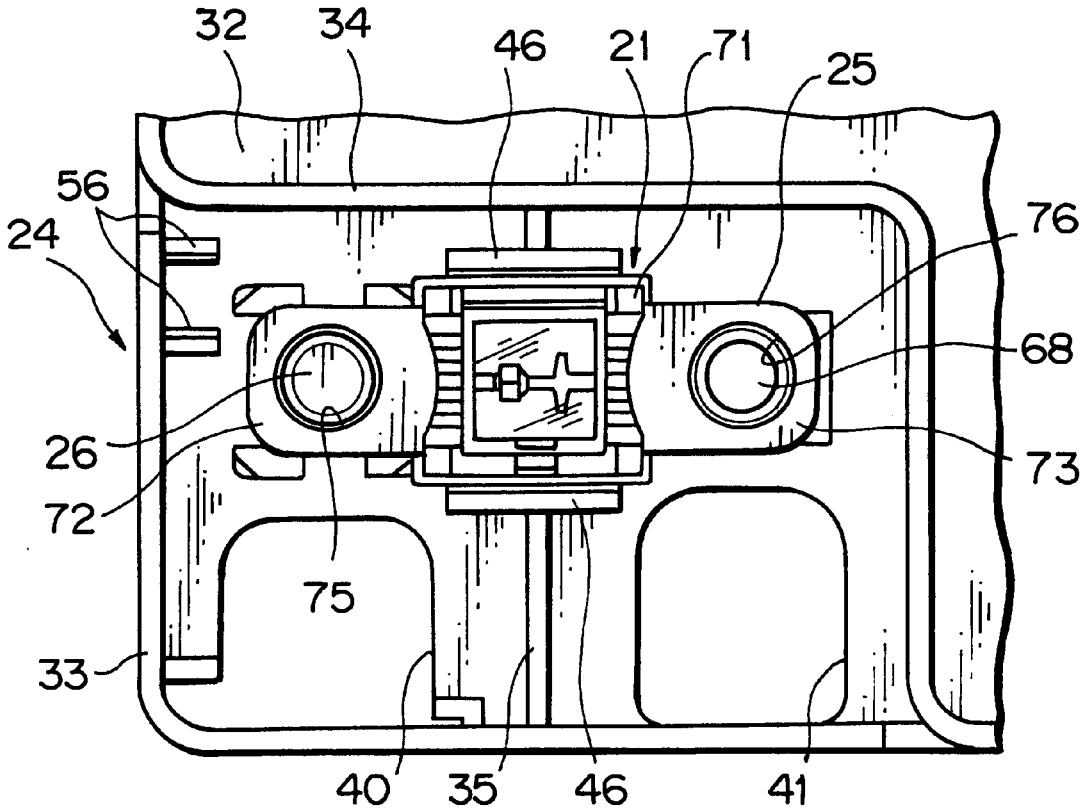
FIG. 7A is a plan view showing the setting portion on which the first and second connecting members and further the fuse link having been assembled.
Figure 7B:
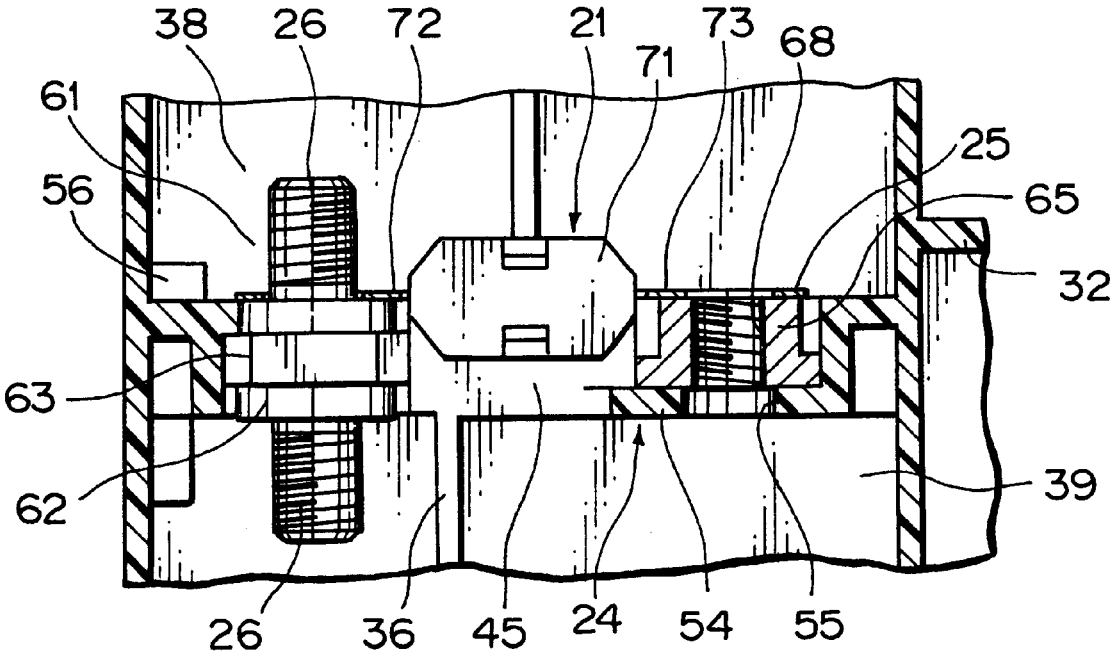
FIG. 7B is a sectional view of FIG. 7A.

FIG. 6A is a plan view showing the setting portion on which the first and second connecting members having been assembled. FIG. 6B is a sectional view of FIG. 6A. FIG. 7A is a plan view showing the setting portion on which the first and second connecting members and further the fuse link having been assembled. FIG. 7B is a sectional view of FIG. 7A.

In FIGS. 6A, 6B, first, the work of setting the first connecting member 61 in the placing space 47 is carried out. Subsequently, work for setting the second connecting member 65 in the placing space. 52 is carried out.

Setting of the first connecting member 61 is carried out through the housing receiving space 45 by sliding the flange 63 of the first connecting member 61 in the placing space 47. And, the flange 63 prevents the first connecting member 61 from turning. The base portion 62 of the first connecting member 61 is held by the ends of the projections 48,49, and the first connecting member 61 does not come back to the housing receiving space 45.

Setting of the second connecting member 65 is carried out also through the housing receiving space 45 by sliding the flange 67 of the second connecting member 65 in the placing space 52. And, the flange 67 prevents the second connecting member 65 from turning. The base portion 66 of the second connecting member 65 is held by the above recesses, and the second connecting member 65 does not come back to the housing receiving space 45. When the second connecting member 65 is properly set, the female threaded portion 68 agrees with the circular hole 55.

Referring to FIGS. 7A, 7B, after completion of setting of the first connecting member 61 and the second connecting member 65, the fuse link 21 is set in the setting space 37.

And, the first conductor 72 is fitted on the male threaded portion 26 through the fitting hole 75. At this time, the resin housing 71 is retained in the housing receiving space 45. And, the fitting hole 76 of the second conductor 73 agrees with the female threaded portion 68. In this state, the fuse link 21 is freely detached from the setting portion 24.

Following the above, connection work of the fuse link 21 and the external terminals 22,23 are described with reference to FIGS. 1A, 1B, 8A, 8B.

Figure 8A:
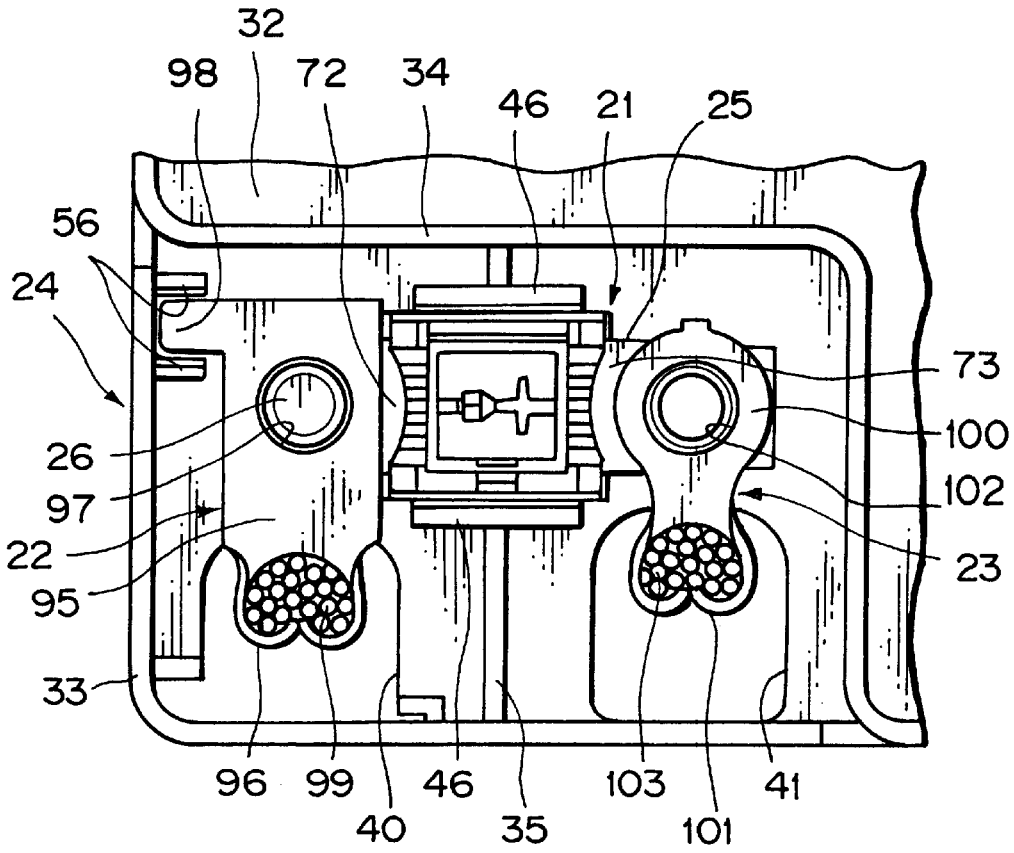
FIG. 8A is a plan view showing the setting portion on which the first and second connecting members, the fuse link, and further external terminals having been assembled.
Figure 8B:
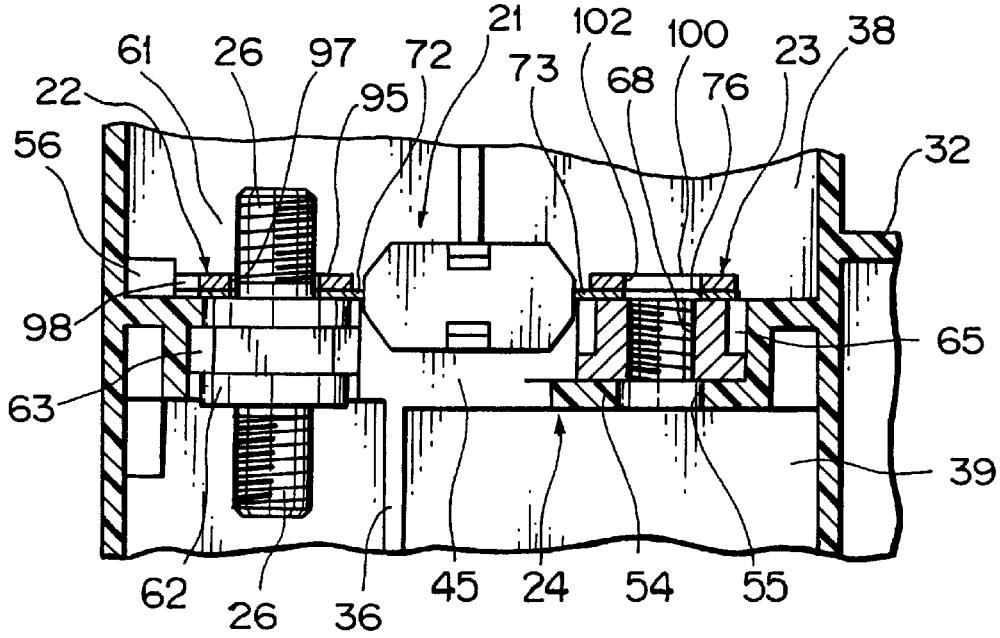
FIG. 8B is a sectional view of FIG. 8A.

FIG. 8A is a plan view showing the setting portion on which the first and second connecting members, the fuse link, and further external terminals having been assembled. FIG. 8B is a sectional view of FIG. 8A.

In FIGS. 8A, 8B, the external terminal 22 is fitted on the male threaded portion 26 through the fitting hole 97. And, the fitting hole 102 of the external terminal 23 is agreed with the fitting hole 76 of the second conductor 73.

As for the external terminal 22, the projecting portion 98 is put between the retaining walls 56,56, and then the external terminal 22 gets in contact with the first conductor 72. On the other hand, the external terminal 23 gets in contact with the second conductor 73.

After completion of setting of the external terminals 22,23, the nut 27 (FIGS. 1A, 1B) is screwed to the male threaded portion 26. And also, the bolt 28 is screwed to the female threaded portion 68, whereby the external terminals 22,23 are conductively-connected with the fuse link 21.

As described hereinabove, the terminal connecting nut 27 and the terminal connecting bolt 28 are used for connection of the external terminals 22,23, connecting position of each of the external terminals 22,23 becomes clear, thereby preventing false assembly thereof.

Another external terminals can also be connected to the first connecting member 61 and the second connecting member 65 from the space 39 side.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A connecting structure of a fuse link and external terminals, comprising:

the fuse link having a metallic fuse member having a fuse portion to be fused by overcurrent for circuit-breaking, a first conductor continuing from one end of the fuse portion, and a second conductor continuing from the other end of the fuse portion;

a setting portion having a first connecting member having a male threaded portion and a second connecting member having a female threaded portion embedded therein so as to retain the fuse link therein; and at least two external terminals to be connected to the metallic fuse member of the fuse link, wherein the male threaded portion is inserted into either one of the first conductor and the second conductor so as to secure at least one of the external terminals thereto by screwing a terminal connecting nut to the male threaded portion and a terminal connecting bolt is inserted into the other one of the first conductor and the second conductor so as to secure the other of the external terminals thereto by screwing the terminal connecting bolt to the female threaded portion.

2. The connecting structure as set forth in claim 1, wherein a base portion of the first connecting member and a base portion of the second connecting member are arranged on a substantially same plane.

* * * * *